US006427408B1

(12) United States Patent
Krieger

(10) Patent No.: US 6,427,408 B1
(45) **Date of Patent: *Aug. 6, 2002**

(54) PANEL ATTACHMENT SYSTEM

(75) Inventor: Kevin Krieger, New Philadelphia, OH (US)

(73) Assignee: Commercial and Architectural Products, Inc., Dover, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/723,103

(22) Filed: Nov. 27, 2000

Related U.S. Application Data

(63) Continuation of application No. 09/220,561, filed on Dec. 23, 1998, now Pat. No. 6,202,377.

(51) Int. Cl.[7] ..... E04B 2/30

(52) U.S. Cl. ..... 52/489.1; 52/586.1; 52/571; 52/506.05; 52/762

(58) Field of Search ..... 52/506.05, 506.01, 52/511, 483.1, 489.1, 586.1, 762, 779, 235

(56) References Cited

U.S. PATENT DOCUMENTS

| | | | |
|---|---|---|---|
| 3,412,515 | A | 11/1968 | Finon |
| 3,530,633 | A | 9/1970 | Scott |
| 3,621,635 | A | 11/1971 | Lang |
| 3,803,789 | A | 4/1974 | Gibson |
| 4,553,366 | A | 11/1985 | Guerin |
| 4,625,481 | A | 12/1986 | Crandell |
| 4,685,263 | A | 8/1987 | Ting |
| 4,765,111 | A | 8/1988 | Osawa |
| 4,783,941 | A | 11/1988 | Loper et al. |
| 4,866,896 | A | 9/1989 | Shreiner et al. |
| 5,069,014 | A | 12/1991 | Kubbutat |
| 5,107,651 | A | 4/1992 | Menchetti et al. |
| 5,155,958 | A | 10/1992 | Huff |
| 5,301,484 | A | 4/1994 | Jansson |
| 5,398,473 | A | 3/1995 | Chan |
| 5,417,020 | A | 5/1995 | Dobija |
| 5,555,689 | A | 9/1996 | Gilmore |
| 5,590,502 | A | 1/1997 | Wendt |
| 5,829,216 | A | 11/1998 | Newcomb et al. |
| 5,979,124 | A | 11/1999 | Branan |

FOREIGN PATENT DOCUMENTS

| | | | |
|---|---|---|---|
| NL | 8701061 | 12/1988 | ..... E04F/13/14 |

*Primary Examiner*—Beth A. Stephan
*Assistant Examiner*—Brian E. Glessner
(74) *Attorney, Agent, or Firm*—Pearne & Gordon LLP

(57) ABSTRACT

A wall system including a plurality of rectangular rigid prefinished panels mounted on a wall support structure with main runners and cross runners. The main runners serve to lock the panels onto the support structure and with the cross runners serve to prevent the panels from warping due to adverse moisture conditions. The main runners are configured to space the panels from the wall support structure to encourage uniform humidity conditions at the front and rear of the panels. Clips that secure the panels to the main runners are fixed adjacent the top and bottom panel edges at different setoffs to obtain an advantageous nesting of panels for reduced packaging volume.

1 Claim, 8 Drawing Sheets

FIG. 8
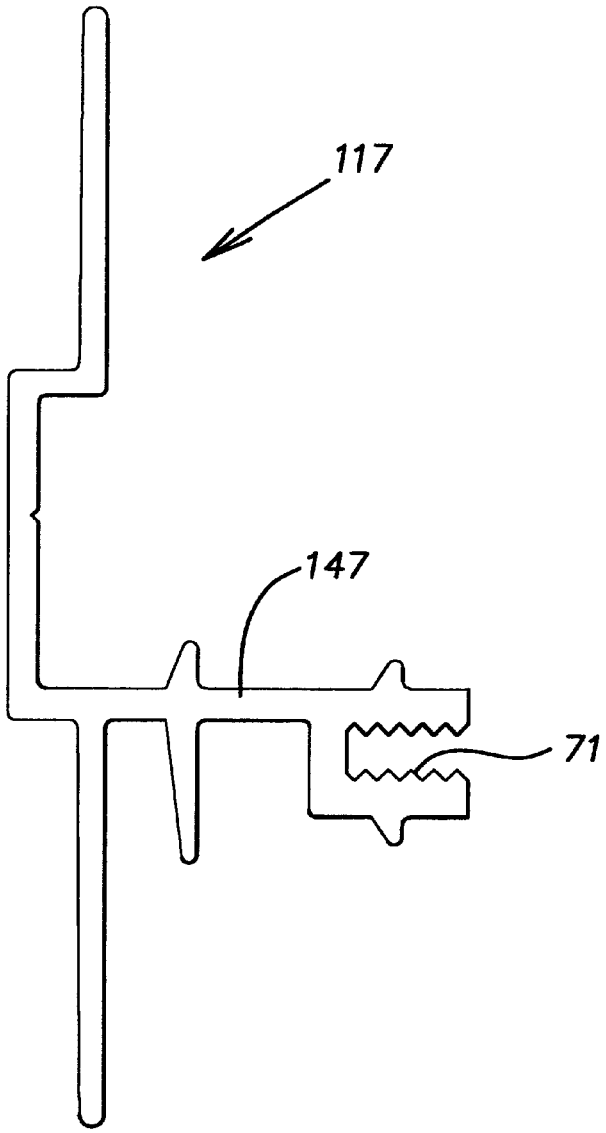
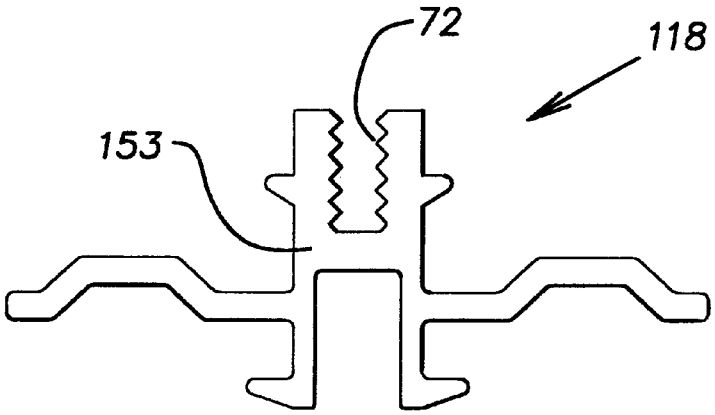
FIG. 9

PANEL ATTACHMENT SYSTEM

This application is a continuation of Ser. No. 09/220,561, filed Dec. 23, 1998 now U.S. Pat. No. 6,202,377.

BACKGROUND OF THE INVENTION

The invention relates to wall construction and, in particular, to a wall system formed of an array of prefinished rectangular panels mechanically held on a wall framework.

PRIOR ART

It is known to construct a wall surface for a room or other structure with a plurality of prefinished rectangular panels. (As used herein, the term "rectangular" includes "square".) Such constructions using a real wood veneer, for example, can achieve a custom high-quality appearance with moderate material and labor costs. Under varied circumstances, prior art panels such as those with a particle board core have exhibited a tendency to warp after installation. This warpage detracts from the appearance of the installation and if severe enough, can require remedial work. It is believed that warpage can be induced by moisture in adhesives used to hold the panels on a substrate or support wall and/or by different moisture levels between the front and rear faces of a panel where air circulation is limited at the back of the panels.

SUMMARY OF THE INVENTION

The invention provides a method and components for an improved wall construction of the type comprising an array of prefinished rectangular panels. In accordance with the invention, the panels are mechanically attached to a supporting wall frame or other structure and the attachment elements are arranged to constrain the panels against warpage.

In a preferred embodiment, the panels are stiffened by rigid runners, preferably made of suitable metal elements, extending substantially along the full length of their edges. The upper and lower edges of the panels are positively secured to the wall frame or other support structure by horizontal runners while the vertical panel edges are located to the wall frame indirectly by the close proximity of the ends of vertical runners to the horizontal runners.

More specifically, elongated panel mounting clips, preferably roll formed members of steel or other suitable metal, are factory attached to the rear or back side of each panel adjacent its upper and lower edges. The clips have a "Z"-like cross section to provide a flange that with the adjacent surface area of the panel forms a groove. These groove constructions at the top and bottom of a panel tightly receive flanges of corresponding main runners to fix the panel in its desired location on the wall framework.

As disclosed, the "Z" clips or brackets at the upper and lower panel edges are preferably at different offsets from their respective edges. This arrangement has the advantage of minimizing shipping bulk and, consequently, cost. The cross runners that stabilize the vertical panel edges in the disclosed embodiment are formed as splines that each tightly fit as a tongue into opposed grooves of adjacent panels. The cross runners or splines thus, in addition to reducing the tendency of the panel to warp also align the edges of adjacent panels to one another to improve the appearance of the installation.

BRIEF DESCRIPTION OF THE DRAWINGS

FIG. 8 is an end view of an alternative main runner; and

FIG. 9 is an end view of an alternative cross runner.

DESCRIPTION OF THE PREFERRED EMBODIMENT

Figure 1:
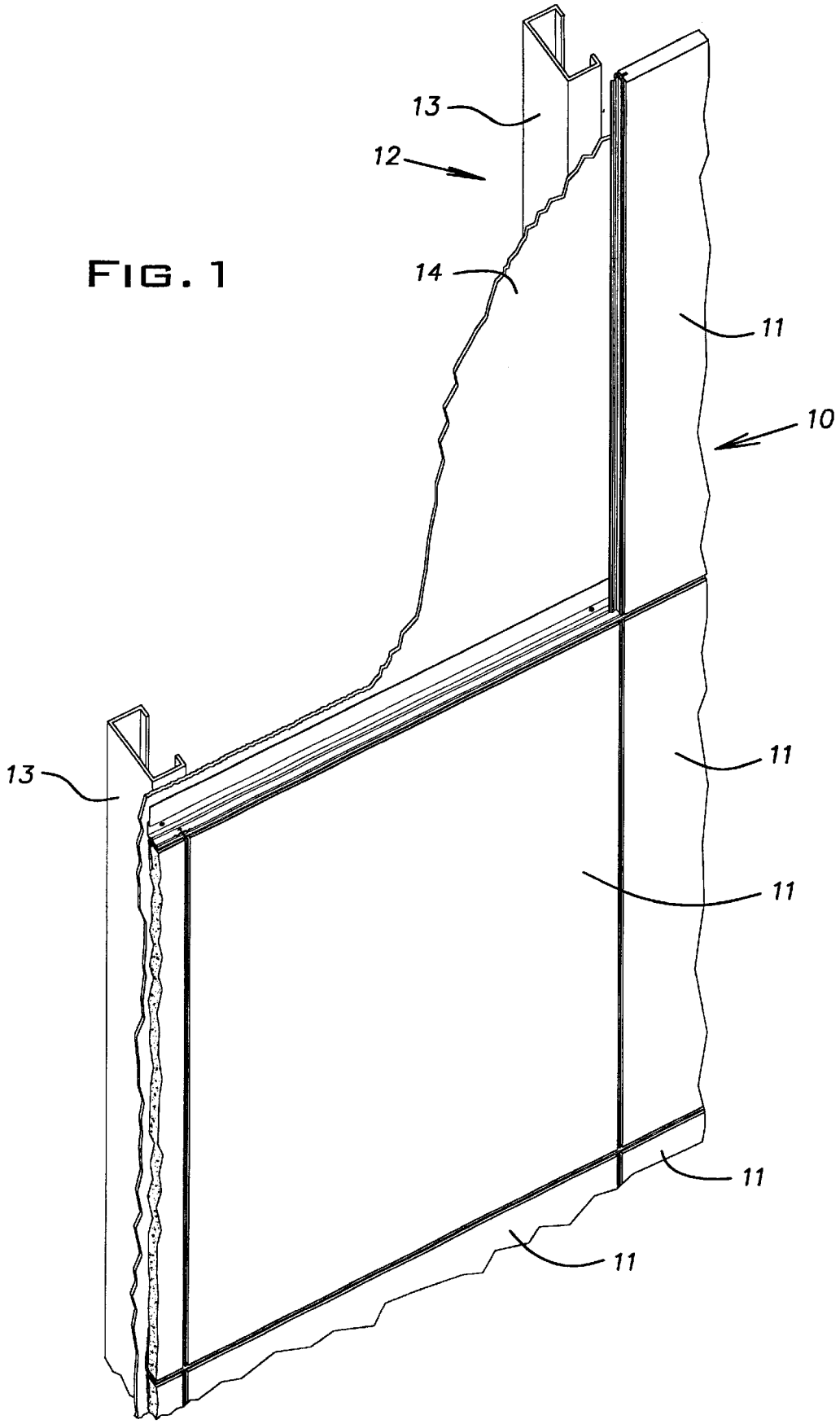
FIG. 1 is a fragmentary perspective view of a wall constructed in accordance with the invention.

Referring now to the drawings, a wall system 10 constructed in accordance with the invention includes a plurality of rigid rectangular panels 11 attached to a wall support structure or framework 12 represented by vertical studs 13 covered by gypsum board or drywall 14. The panels 11 are mechanically attached to the framework studs 13 with elongated clips 16 that grip horizontal runners 17. Adjacent vertical edges of the panels 11 are mutually aligned by cross runners 18.

The panels 11, which can be identical for the most part, are an assembly of a flat, rigid board-like unit 19 and a pair of the clips 16 attached to a rear face 22 of the board 19. A panel board 19 can comprise any suitable construction material and in the preferred embodiment comprises a laminate of two outer face layers 26 and 27 and an intermediate core 28. The core can be commercially available particle board that consists primarily of wood particles bonded together with known materials. This particle board and similar cellulose based materials are particularly suited for the present invention since they afford both economy and adequate tensile and compressive strength. An exterior or front surface 29 of the face 27 typically has a final finish when it leaves the panel factory. For example, where the face or layer 27 is a wood veneer, it can be sanded, stained, and lacquered or otherwise prefinished before shipment from the factory where the panel 11, as described, is manufactured. The panels 11 have nominal common face dimensions of, for example, 2 foot×2 foot square, or 2 foot high×4 foot wide. It will be understood, however, other suitable dimensions are envisioned.

Figure 7:
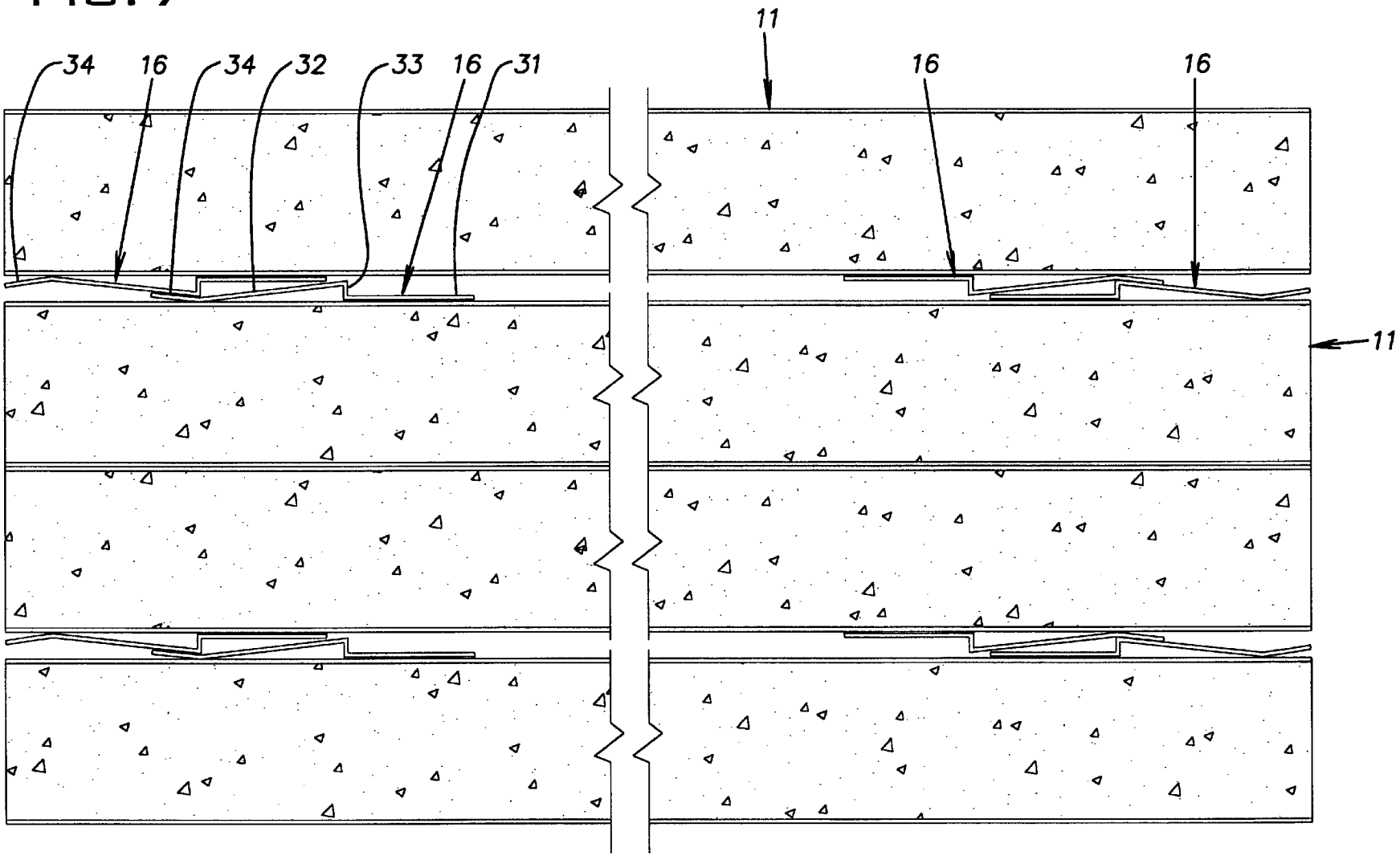
FIG. 7 is an end view of a plurality of panels stacked for shipment and/or storage.
Figure 7A:
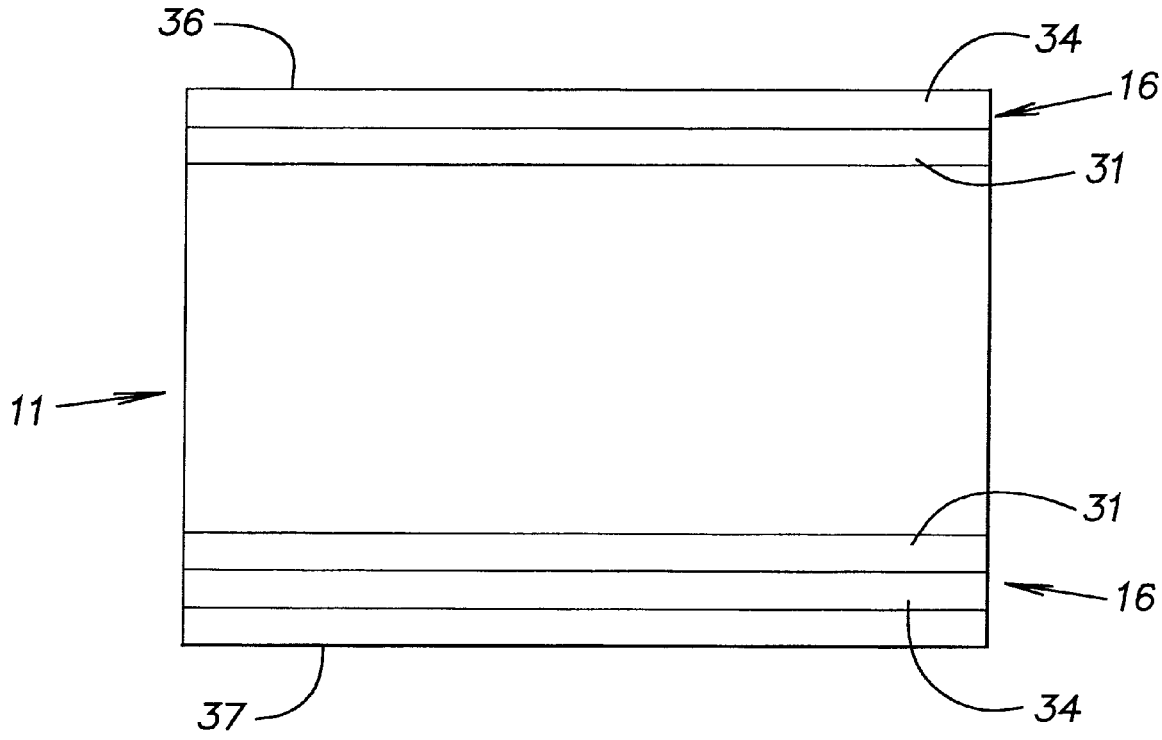
FIG. 7A is a plan view on a reduced scale showing the rear face of a panel having clips mounted thereto.

Referring to FIGS. 7 and 7A clips 16 fixed to the rear faces 22 of the panel board 19 can be roll formed sheet steel or aluminum, for example. In the illustrated construction, the clips 16 are identical at both the top and bottom edges of a panel board 19 and have a length equal to or slightly shorter than the horizontal length of the panel board. The cross section of a clip 16, as shown in FIG. 7, is "Z"-shaped albeit somewhat shortened and broadened with generally planar flanges 31, 32 and an intermediate web 33. One flange 31 is secured against the panel board 19 either directly abutting it or adhered to it. The clips 16 are fixed to the rear panel face 22 with suitable means such as mechanical fasteners in the form of screws, staples or the like and/or an adhesive fastening medium. The other flange 32 has its edge remote from the web 33 bent outwardly slightly forming a lip 34 which facilitates assembly with a main runner 17 as explained below. At an upper edge 36 of a panel board 19, the clip 16 is closely adjacent the edge while at a lower edge 37 the clip is adjacent but spaced a predetermined distance from this edge.

Vertical edges 38 of the panel boards 19 are provided with a groove 39 running their full length and preferably centered in the thickness of the board and having a round bottom to reduce any tendency of a stress induced fracture in this area. By way of example, the panel boards 19 can have representative thicknesses of ¾", ⅝", or ½" with the thicker dimensions being preferred where greater strength is required. The grooves 39 can be ⅛" wide and approximately 9/16" deep.

Figure 2:
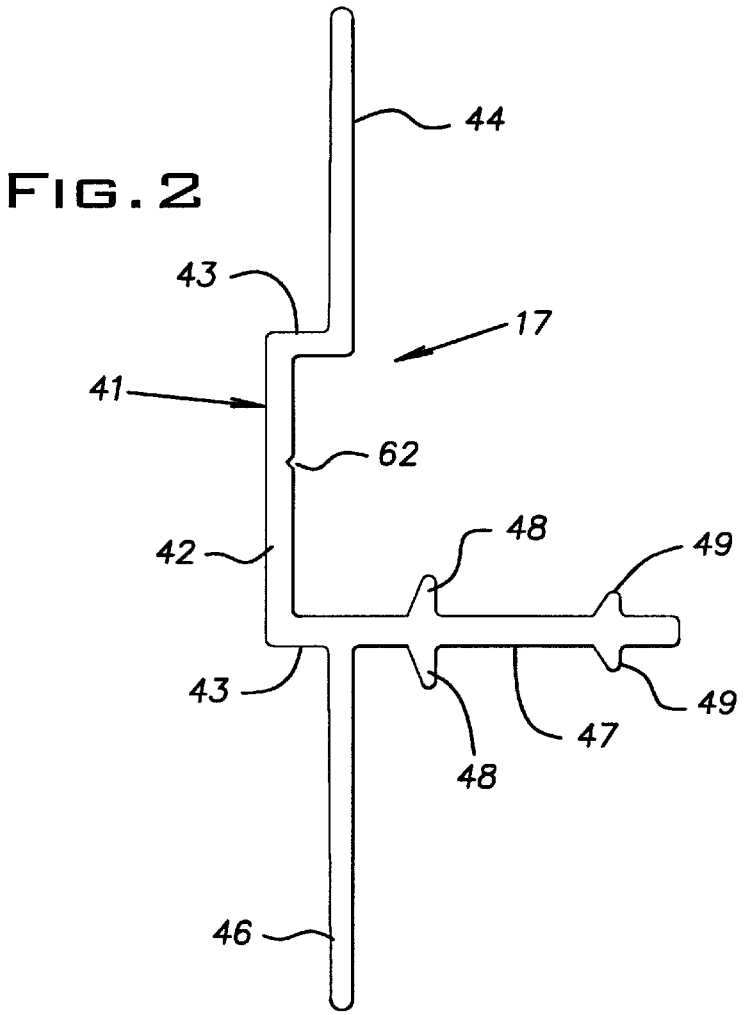
FIG. 2 is an enlarged end view of a main runner.

The illustrated main horizontal runners 17 are extruded aluminum members with an irregular, asymmetrical cross section. This cross section, with particular reference to FIG. 2, includes a central channel section 41 with a web 42 and flanges 43. The flanges have extended portions 44, 46 that project oppositely of one another in a common plane parallel to but spaced from the plane of the web 42. The main runner cross section also includes an extension 47 of a lower one of the flanges 43. The extension has ribs 48, 49 that are useful in gauging the vertical gap between adjacent panels 11. The main runners 17 have a length preferably at least equal to the combined horizontal length of two panels 11, and can be, for example, 8, 10 or 12 feet long.

Figure 3:
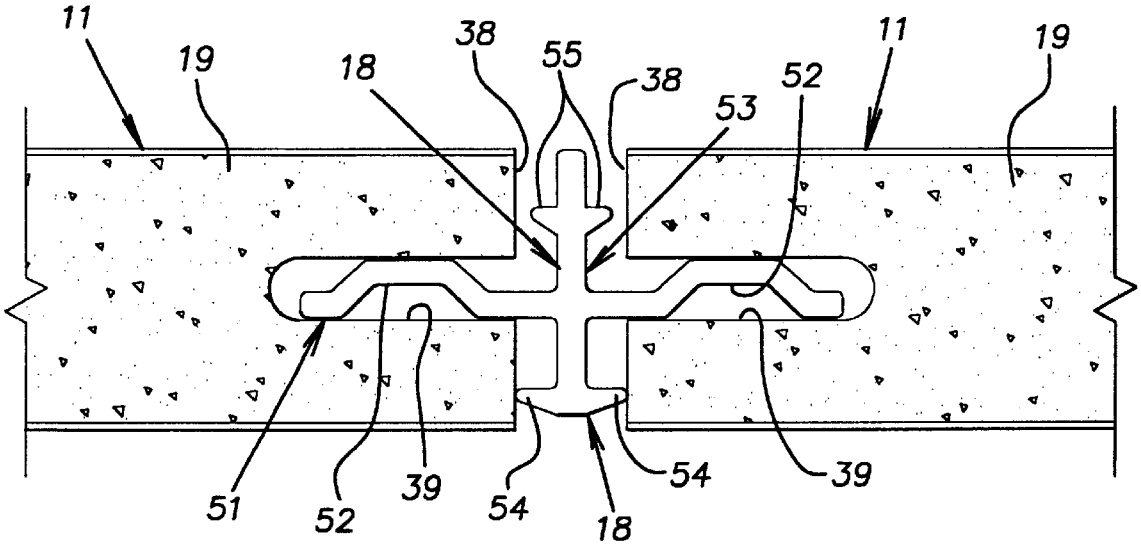
FIG. 3 is an enlarged end view of a cross runner and portions of adjacent panels.

FIG. 3 illustrates an end view of a cross runner 18. As shown, the cross runner 18 has an irregular cruciform shape in section. One part 51 of the cruciform has corrugations 52 while another part 53 has ribs 54, 55. The illustrated cross runner 18 is made as an aluminum extrusion. The cross runners 18 have lengths generally equal to the vertical height of a panel 11.

The panels 11 are installed on the wall support structure 12 by assembling a first row of panels 11, typically starting at floor level, along the base of the supporting wall structure with a cross runner 18 assembled in the opposed vertical slots or grooves 39 of adjacent panels 11. The horizontal spacing between the panels 11 is determined by abutting the panel edges 38 against the cross runner ribs 54. The panels 11 are mechanically locked in position relative to the support structure 12 by positioning the lower flange portion or extension 46 of a main runner 17 into a groove or slot 56 formed by the clips 16 adjacent the upper edges 36 of the panel boards 19 and then securing the main runner to the support structure. In the illustrated case, this, is accomplished by driving a self-tapping screw 61 through the web 42 into each of the studs 13. A shallow groove 62 can be formed in the profile of the inside of the channel 41 to locate and stabilize the screw 61 as it is driven. The lower edges 37 of the first course or row of panels 11 can be secured to the support structure by suitable mechanical or adhesive means or other known fastening means. If desired, a "Z" strip with the proportions of the main runner channel 41 and upper flange portion or extension 44 can be used for this purpose. It should be understood that where desired, the main runners 17 can be secured directly to an open framework made up of studs or other elements not covered by gypsum board or other board material.

After a sufficient length of a main runner or runners 17 has been set and fixed to the wall support structure 12 with the lower flange area 46 received in the slot or groove 56 formed by the clips 16 and adjacent rear face areas 22 of the panel boards 19, a second course or row of panels 11 is installed above the first row. This is accomplished by manipulating the panels 11 to cause the upper flange 44 of the main runner to be received in a slot or groove 57 formed between the lower clip 16 and the rear faces 22 adjacent the lower edges 37 of the second row of panels 11. Each panel 11 is forced downwardly until the upper flange 44 of the main runner 17 is fully received in the groove 57 created between the clip 16 and panel board 19 and the lower edge 37 contacts the rib 48 of the main runner. As before, a cross runner 18 is inserted in the opposed vertical grooves 39 of adjacent panel boards 19. When this second course of panels 11 has been put in place, the process of securing it to the wall structure with a main runner 17 at the upper panel edges 36 is repeated. In the same manner, subsequent rows or courses of panels 11 are positioned on the wall with cross runners 18 disposed between the panels and main runners 17 located at the lower and upper edges 36, 37 of the panels. This process is repeated until the wall support structure 12 is covered by the panels 11 to the extent desired.

Figure 4:
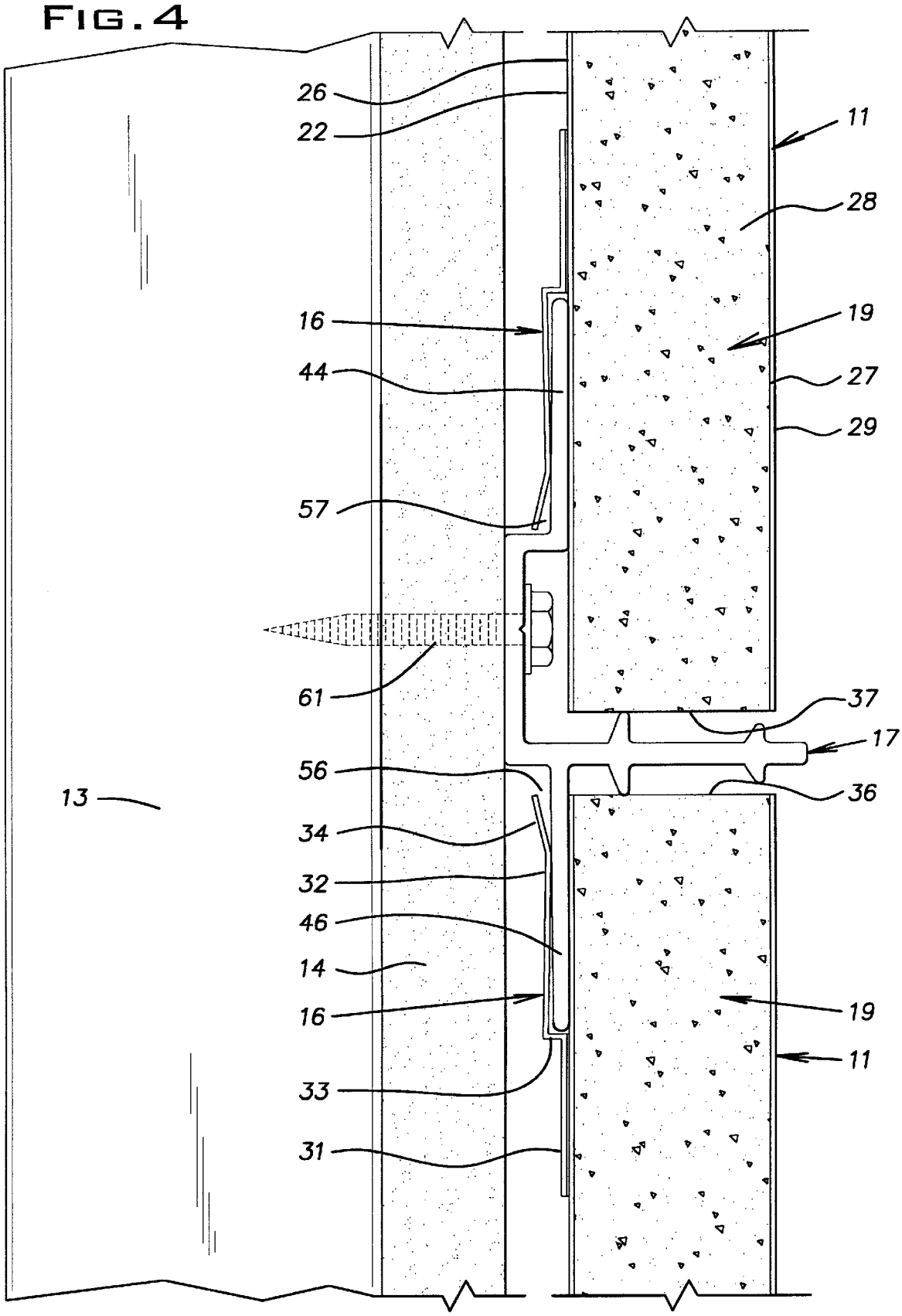
FIG. 4 is a cross sectional view of the wall of FIG. 1 taken in a vertical plane.

The effective thickness of the cross runner part 51 that is received in a groove 39 is proportioned to provide an interference with the groove to ensure a tight fit therewith. It will be seen that the cross runners 18 serve to align adjacent panel edges 38 to one another. As shown in FIG. 7, the clips 16 can be made with the flange 32, in its free state, close to the rear face 22 so that a somewhat tight interference fit is achieved between this flange and the main runner flange 44. Inspection of FIG. 4 reveals that the channel-like structure of the main runner 17 serves to space the panels 11 away from any subwall such as that represented by the gypsum board 14. This spacing ensures that adequate air circulation exists around the panels so that any tendency of a differential in moisture content between the front and back of the panels 11 is reduced and, consequently, a tendency for the panels to warp from moisture conditions is reduced. It will be understood that panels such as the illustrated panels 11, formed of wood or similar cellulose based materials, can be particularly susceptible to moisture-induced warping. The disclosed wall system 10 is effective in overcoming the problem of warpage of such panels since the main and cross runners 17, 18 which are relatively rigid and free of moisture related warpage, engage substantially the full perimeter of each panel and serve to maintain the corresponding edges of the panel in a common plane thereby preventing visually distracting warpage.

Figure 5:
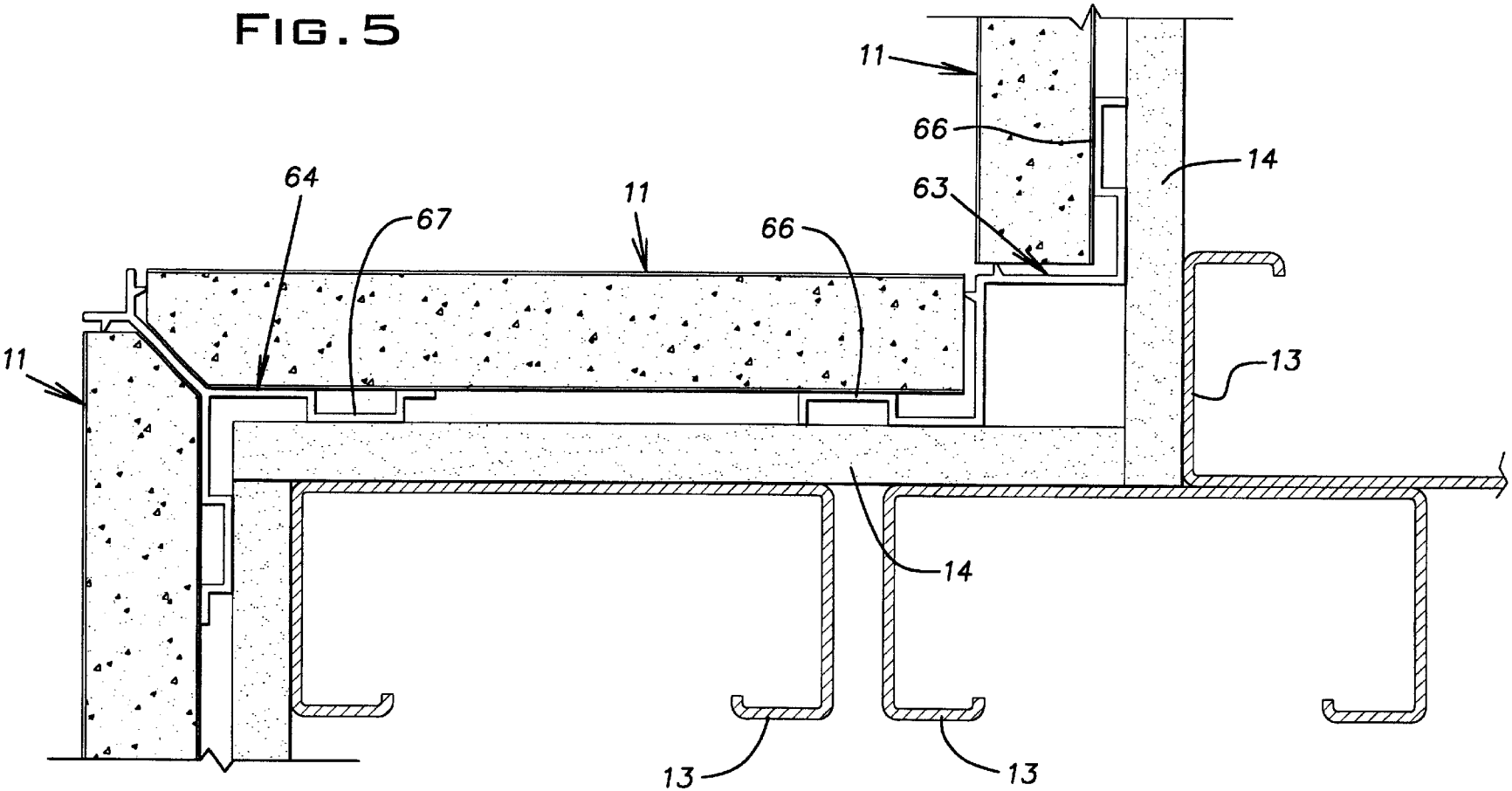
FIG. 5 is a cross sectional view taken in a horizontal plane at an inside and an outside corner of a wall constructed like that of FIG. 1.
Figure 6:
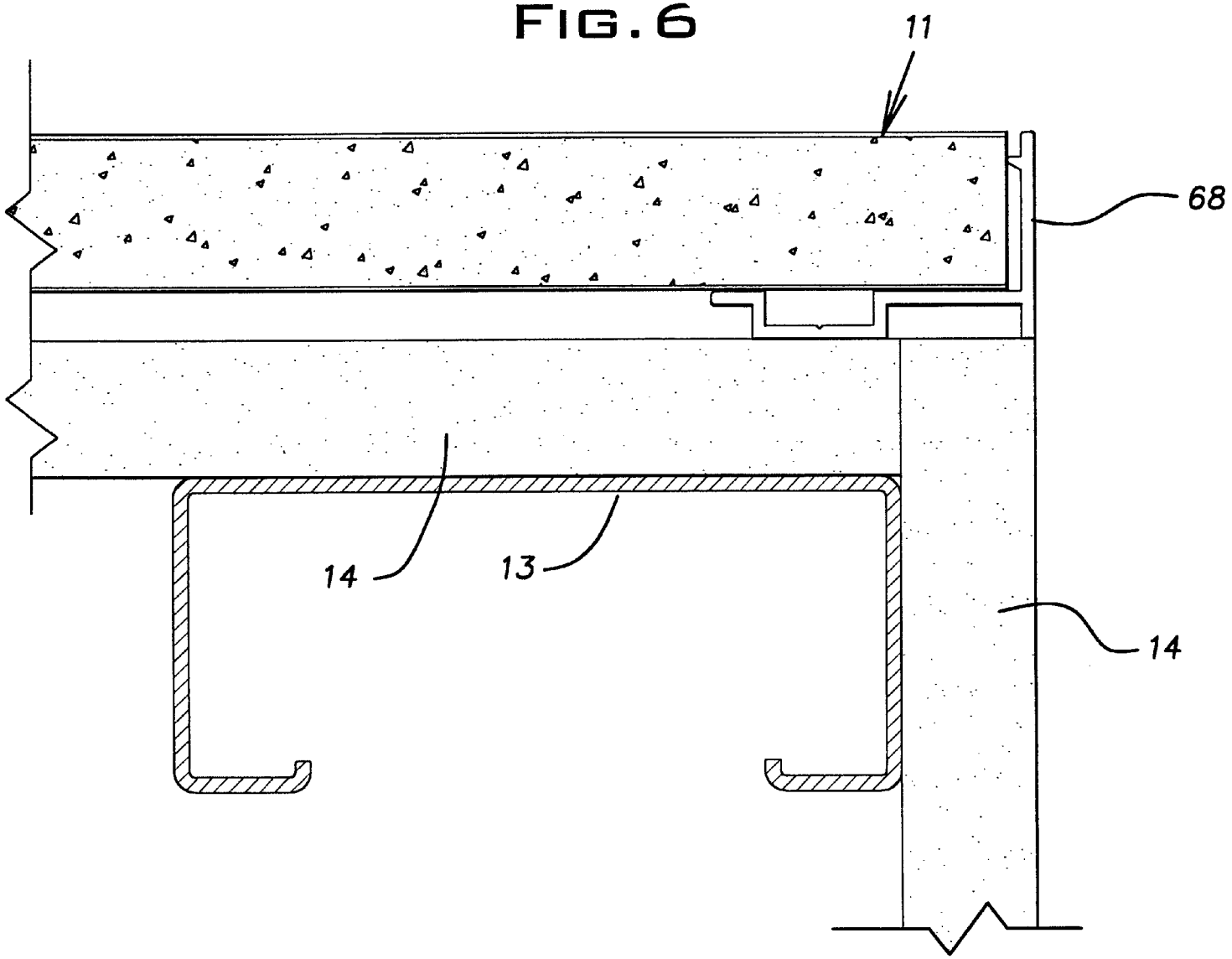
FIG. 6 is a cross sectional view taken in a horizontal plane of an end of a wall constructed like that of FIG. 1.

FIG. 5 is a cross section of a wall system constructed in accordance with the invention taken in a horizontal plane to illustrate metal corner accessories 63, 64 at inside and outside corners, respectively. The accessories, 63, 64 can be aluminum extrusions and can include channel structures 66, 67 to appropriately space the panels 11 from the subwall. FIG. 6 similarly illustrates an aluminum extrusion accessory 68 for the end of a wall.

With reference to FIG. 7, the offset of one of the clips 16 from its adjacent edge 37 allows a pair of panels 11 to be stacked rear face to rear face and offset clip to non offset clip so as to reduce the effective bulk of the panels and thereby reduce storage and shipping expense.

FIGS. 8 and 9 illustrate modified forms of a main runner 117 and a cross runner 118. In these arrangements, a flange extension 147 and cruciform part 153 have channels 71, 72, respectively, which exist between edges of associated panels 11 and are adapted to receive the stem of a decorative strip having a T-shaped cross section as is known in the art.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed is:

1. A finished wall construction comprising a plurality of rectangular generally planar panels arranged in rows and columns in a vertical plane with their edges lying in vertical and horizontal orientations and runners adjacent the edges of the panels, the panels having a front face and a rear face and being constructed of material selected from wood material and material which is susceptible to warping because of ambient humidity conditions, the runners being formed of a material selected from metal and relatively stiff structural material that is substantially free of a tendency to warp due to ambient humidity conditions, the panels each having grooves along substantially the full length of each of its edges, the runners being received in the grooves of the four edges of the panels, along substantially the full length of the respective grooves, the runners being proportioned to fit in their respective grooves tightly as received therein so that there is no significant clearance in a direction perpendicular to a plane of the arranged panels, each panel having a pair of said runners on opposite edges attached to a supporting wall in a manner that permits such runners to hold the panel in place relative to the supporting structure.

* * * * *